US010128616B2

(12) United States Patent
Morgan et al.

(10) Patent No.: US 10,128,616 B2
(45) Date of Patent: Nov. 13, 2018

(54) ELECTRICAL CONNECTOR HAVING COMMONED GROUND SHIELDS

(71) Applicant: TYCO ELECTRONICS CORPORATION, Berwyn, PA (US)

(72) Inventors: Chad William Morgan, Carneys Point, NJ (US); Timothy Robert Minnick, Enola, PA (US); Arturo Pachon Munoz, Hummelstown, PA (US); David Wayne Helster, Dauphin, PA (US); Brian Patrick Costello, Scotts Valley, CA (US); Douglas Edward Lawrence, Sinking Spring, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/218,189

(22) Filed: Jul. 25, 2016

(65) Prior Publication Data

US 2018/0026400 A1 Jan. 25, 2018

(51) Int. Cl.

| | |
|---|---|
| ***H01R 13/648*** | (2006.01) |
| ***H01R 13/646*** | (2011.01) |
| ***H01R 12/52*** | (2011.01) |
| ***H01R 13/424*** | (2006.01) |
| ***H01R 13/514*** | (2006.01) |
| ***H01R 12/58*** | (2011.01) |
| ***H01R 13/6586*** | (2011.01) |

(52) U.S. Cl.

CPC ..... *H01R 13/646* (2013.01); *H01R 12/52* (2013.01); *H01R 12/58* (2013.01); *H01R 13/424* (2013.01); *H01R 13/514* (2013.01); *H01R 13/6586* (2013.01)

(58) Field of Classification Search

CPC ..... H01R 9/096; H01R 23/688; H01R 13/65802; H01R 23/7073

USPC ... 439/65, 108, 607.01, 607.05, 607.07, 660

See application file for complete search history.

(56) References Cited

U.S. PATENT DOCUMENTS

| | | | | |
|---|---|---|---|---|
| 8,449,330 | B1 * | 5/2013 | Schroll | H01R 13/514 439/607.06 |
| 8,845,365 | B2 * | 9/2014 | Schroll | H01R 9/034 439/607.27 |
| 8,905,767 | B2 * | 12/2014 | Putt, Jr. | H01R 9/034 439/101 |
| 8,905,786 | B2 | 12/2014 | Davis et al. | |
| 8,961,229 | B2 * | 2/2015 | Pan | H01R 13/6474 439/607.07 |

(Continued)

*Primary Examiner* — Thanh Tam Le

(57) ABSTRACT

An electrical connector includes a housing and contact assemblies. The housing includes shroud walls and a base having a front side and a rear side. The front side of the base and the shroud walls define a cavity configured to receive a mating connector. The base is electrically conductive and has chambers extending therethrough that are defined by chamber walls. The contact assemblies are received in the chambers. Each contact assembly has a signal pod surrounded on at least two sides by a ground shield. The signal pod includes a dielectric body holding a pair of signal contacts. The dielectric body engages interior sides of the ground shield to electrically insulate the signal contacts from the ground shield. Exterior sides of the ground shield engage the chamber walls of the base to electrically connect the ground shield to the base.

19 Claims, 7 Drawing Sheets

(56) References Cited

U.S. PATENT DOCUMENTS

| | | | | |
|---|---|---|---|---|
| 8,992,252 | B2 * | 3/2015 | McClellan | H01R 13/6581 439/108 |
| 9,017,103 | B2 * | 4/2015 | Davis | H01R 23/688 439/607.05 |
| 9,240,638 | B2 * | 1/2016 | Peloza | H01R 12/73 |
| 9,356,401 | B1 * | 5/2016 | Horning | H01R 13/6585 |
| 9,401,569 | B2 * | 7/2016 | Davis | H01R 13/6585 |
| 9,515,429 | B2 * | 12/2016 | De Geest | H01R 23/005 |
| 2012/0252271 | A1 * | 10/2012 | Pan | H01R 13/6586 439/607.01 |

* cited by examiner

ELECTRICAL CONNECTOR HAVING COMMONED GROUND SHIELDS

BACKGROUND OF THE INVENTION

The subject matter herein relates generally to an electrical connector having signal contacts and associated ground shields.

Some electrical connector systems utilize receptacle and header connectors to interconnect two circuit boards, such as a motherboard and daughtercard. When the connectors are mated, the circuit boards may be arranged parallel to one another. Such connector systems can be complex and difficult to manufacture. The connectors can have ground shields that are designed to shield signal contacts from other signal contacts within the connectors. The ground shields may be electrically commoned at the circuit boards, but a lack of commoning of the ground shields in a region between the circuit boards reduces the shielding effectiveness and therefore inhibits electrical performance of the connector system. For example, gaps between adjacent ground shields within the connectors may allow electrical resonance that interferes with signal transmission, thus reducing signal integrity. Such electrical interference is typically exacerbated by increasing signal transmission speeds through the connector assembly.

A need remains for an electrical connector having enhanced ground shielding that improves electrical performance.

BRIEF DESCRIPTION OF THE INVENTION

In one embodiment, an electrical connector is provided that includes a housing and contact assemblies. The housing extends between a mating end and a mounting end. The housing includes shroud walls and a base having a front side and a rear side. The rear side of the base defines the mounting end. The shroud walls extend from the base to the mating end. The front side of the base and the shroud walls define a cavity configured to receive a mating connector therein. The base is electrically conductive. The base has chambers extending therethrough. The chambers are defined by chamber walls that extend from the front side to the rear side of the base. The contact assemblies are received in the chambers of the base. Each contact assembly has a signal pod surrounded on at least two sides by a ground shield having interior sides and exterior sides. The signal pod includes a dielectric body holding a pair of signal contacts. The dielectric body engages the interior sides of the ground shield to electrically insulate the signal contacts from the ground shield. The exterior sides of the ground shield engage the chamber walls of the base to electrically connect the ground shield to the base.

In another embodiment, an electrical connector is provided that includes a housing and contact assemblies. The housing has a base extending between a front side and a rear side. The base is electrically conductive. The base has chambers extending therethrough. The chambers are defined by chamber walls that extend from the front side to the rear side of the base. The contact assemblies are received in the chambers of the base. Each contact assembly has a signal pod surrounded on at least two sides by a ground shield having interior sides and exterior sides. The signal pod includes a dielectric body holding a pair of signal contacts. The dielectric body engages the interior sides of the ground shield to electrically insulate the signal contacts from the ground shield. The exterior sides of the ground shield engage the chamber walls of the base to electrically connect the ground shield to the base. The exterior sides of the ground shield engage the chamber walls at multiple contact locations along a height of the base between the front side and the rear side to electrically connect the ground shield to the base at the multiple contact locations.

DETAILED DESCRIPTION OF THE INVENTION

Figure 1:
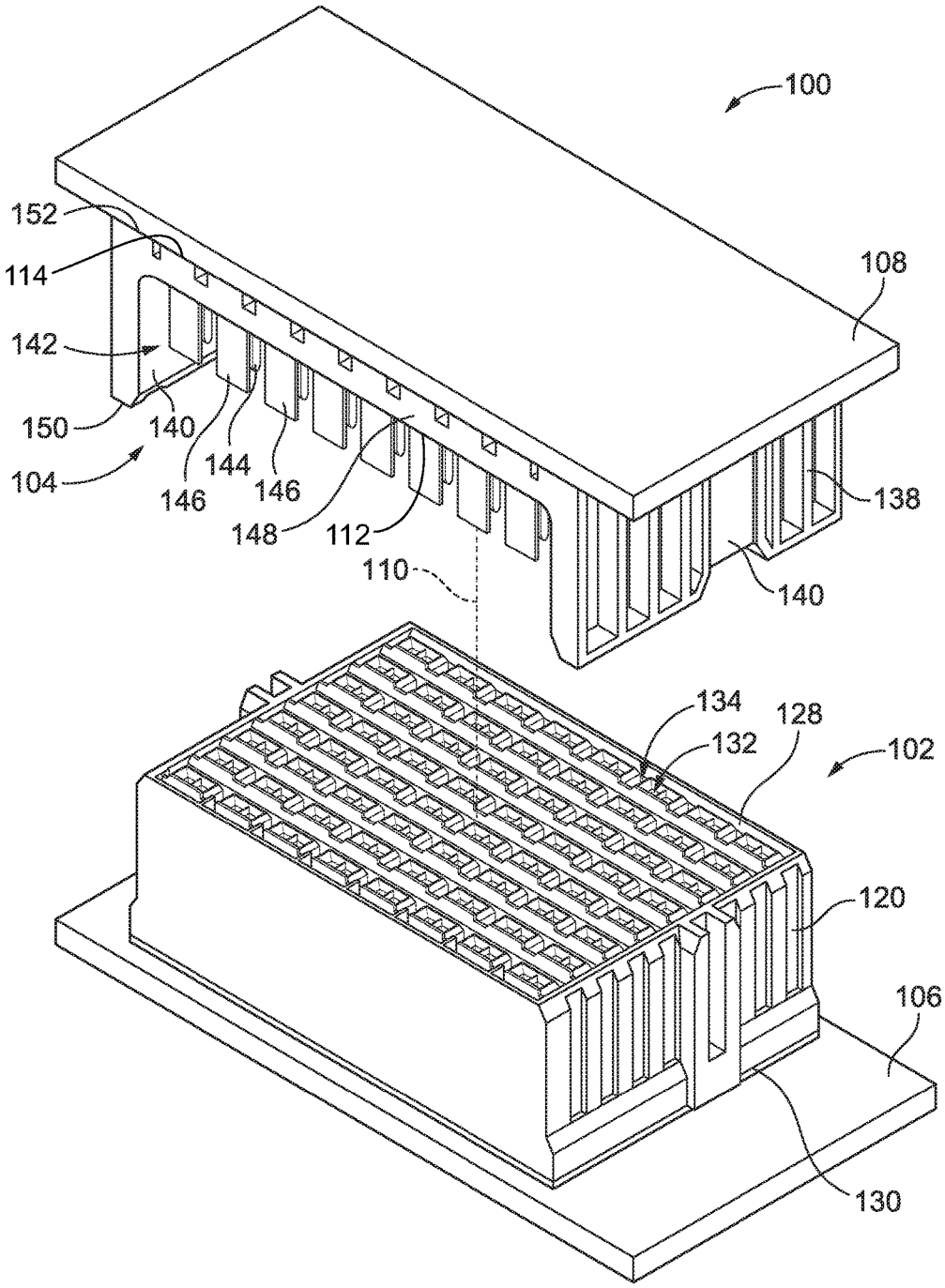
FIG. 1 is a perspective view of a connector assembly illustrating a receptacle connector and a header connector poised for mating according to an embodiment.

FIG. 1 is a perspective view of a connector assembly 100 illustrating a receptacle connector 102 and a header connector 104 poised for mating according to an embodiment. The receptacle and header connectors 102, 104 may be directly mated together along a mating axis 110 to provide a signal transmission path. In an embodiment, the receptacle connector 102 and header connector 104 are provided in a mezzanine arrangement between circuit boards. For example, the receptacle connector 102 is mounted to and electrically connected to a first circuit board 106, and the header connector 104 is mounted to and electrically connected to a second circuit board 108. The receptacle and header connectors 102, 104 are utilized to electrically connect the circuit boards 106, 108 to one another at a separable mating interface.

In an exemplary embodiment, the circuit boards 106, 108 are oriented parallel to one another and spaced apart from one another with the connectors 102, 104 therebetween. The circuit boards 106, 108 and connectors 102, 104 define a mezzanine arrangement where the circuit boards 106, 108 and connectors 102, 104 are stacked. The circuit boards 106, 108 may be oriented horizontally with the connectors 102, 104 defining vertical connectors between the horizontal circuit boards 106, 108. The signal contacts of the connectors 102, 104 pass in-line or linearly therethrough in a vertical direction. Other orientations of the circuit boards 106, 108 are possible in alternative embodiments. For example, one or both of the connectors 102, 104 may be a right angle connector instead of an in-line connector. In another embodiment, one or both of the connectors 102, 104 may be cable-mounted to an electrical cable instead of mounted to a circuit board.

The receptacle connector 102 includes a receptacle housing 120 that holds a plurality of receptacle signal contacts (not shown). The receptacle signal contacts are electrically shielded by receptacle ground contacts (not shown). The receptacle housing 120 extends between a mating end 128 and a mounting end 130. In the illustrated embodiment, the mounting end 130 is substantially parallel to the mating end 128. The receptacle housing 120 includes a plurality of signal contact openings 132 and a plurality of ground contact openings 134 at the mating end 128. The receptacle signal contacts are disposed in the corresponding signal contact openings 132, and the receptacle ground contacts are disposed in the ground contact openings 134. The signal contact openings 132 receive corresponding header signal contacts 144 therein when the receptacle and header connectors 102, 104 are mated to allow the header signal contacts 144 to mate with the receptacle signal contacts. The ground contact openings 134 receive header ground shields 146 therein when the receptacle and header connectors 102, 104 are mated to allow the header ground shields 146 to mate with the receptacle ground contacts.

The receptacle housing 120 may be manufactured from a dielectric material, such as a plastic material, that provides electrical insulation between the signal contact openings 132 and the ground contact openings 134. Therefore, the receptacle housing 120 may electrically insulate the receptacle signal contacts and the header signal contacts 144 in the signal contact openings 132 from the receptacle ground contacts and the header ground shields 146 in the ground contact openings 134. The receptacle signal contacts protrude beyond the mounting end 130 of the receptacle housing 120 for electrically terminating (for example, electrically connecting in direct mechanical engagement) to the first circuit board 106.

The header connector 104 includes a header housing 138 extending between a mating end 150 and an opposite mounting end 152 that is mounted to the second circuit board 108. Optionally, the mounting end 152 may be substantially parallel to the mating end 150. The header housing 138 includes a base wall or housing base 148, referred to herein as a base 148, that has a front side 112 and an opposite rear side 114. The rear side 114 of the base 148 may define the mounting end 152 of the header housing 138. The rear side 114 faces the circuit board 108. The header signal contacts 144 and the header ground shields 146 are held by the base 148. The signal contacts 144 and ground shields 146 extend from the base 148 to be received in the respective signal contact openings 132 and ground contact openings 134 of the receptacle housing 120 when the connectors 102, 104 are mated. The header signal contacts 144 and the header ground shields 146 have terminating ends that extend through the base wall 148 and are mounted to the circuit board 108.

In one or more embodiments described herein, the header housing 138 is fully or at least partially electrically conductive. For example, the base 148 is electrically conductive due to being composed entirely of one or more metals, being composed of a non-conductive core material that is coated in a layer of metal, being composed of a lossy material having metal particles embedded in a non-conductive material, being composed of a conductive polymer material, being composed of a carbon-filled polymer, or the like. The electrically conductive base 148 engages the header ground shields 146 held in the base 148 to electrically common the header ground shields 146 with one another. The header signal contacts 144 are electrically insulated from the electrically conductive base 148 to avoid potential short-circuits. Electrically commoning the ground shields with one another along the base 148 of the housing 138 may improve the shielding effectiveness and, as a result, may provide enhanced signal performance relative to known connector systems.

In an embodiment, the header housing 138 also includes shroud walls 140 that extend from the base 148 and define the mating end 150 of the housing 138. The shroud walls 140 and the front side 112 of the base 148 define a cavity 142. For example, the shroud walls 140 define sides of the cavity 142 and the base 148 defines an end or bottom of the cavity 142. The header signal contacts 144 and ground shields 146 extend from the base 148 into the cavity 142. The receptacle connector 102 is received in the cavity 142 through the mating end 150. The receptacle housing 120 may engage the shroud walls 140 to guide the receptacle connector 102 into the cavity 142.

Figure 2:
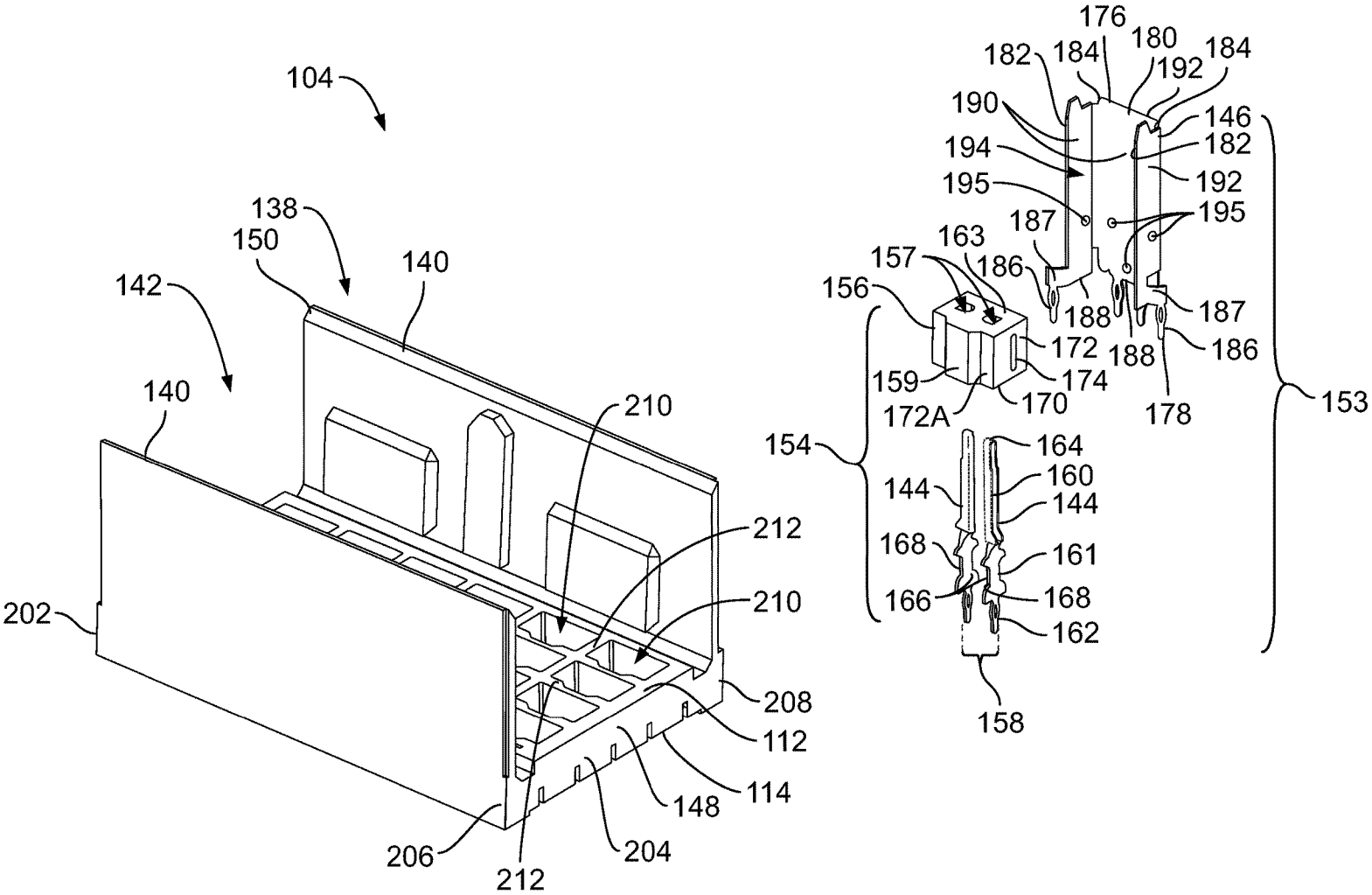
FIG. 2 is an exploded perspective view of the header connector according to an embodiment.

FIG. 2 is an exploded perspective view of the header connector 104 according to an embodiment. The header connector 104 includes the header housing 138 (referred to herein as housing 138) and multiple contact assemblies 153. Only one contact assembly 153 is shown in FIG. 2, and the illustrated contact assembly 153 is exploded to show the individual components of the contact assembly 153. The illustrated contact assembly 153 may be representative of other contact assemblies 153 of the header connector 104. Each contact assembly 153 includes a signal pod 154 and a header ground shield 146 (referred to herein as ground shield 146). The signal pod 154 includes a pair 158 of header signal contacts 144 (referred to herein as signal contacts 144) and a dielectric body 156 that holds the signal contacts 144.

The pair 158 of signal contacts 144 may be used to convey differential signals. The signal contacts 144 may extend generally parallel to each other. The signal contacts 144 are composed of a conductive material, such as one or more metals like copper, aluminum, silver, or the like. The signal contacts 144 may be stamped and formed.

The signal contacts 144 each have a mating segment 160, a contact tail 162, and an intermediate segment 161 between the mating segment 160 and the tail 162. The mating segment 160 extends to a distal end 164 of the signal contact 144 and is configured to engage a corresponding receptacle signal contact (not shown) of the receptacle connector 102 (shown in FIG. 1) when the connectors 102, 104 are mated. The mating segment 160 in the illustrated embodiment is a pin or blade, but may have another shape in an alternative embodiment, such as a socket. Each signal contact 144 has two broad sides 166 and two edge sides 168 that extend between the broad sides 166. The broad sides 166 are wider than the edge sides 168.

The contact tails 162 of the signal contacts 144 are configured to terminate to the circuit board 108 (shown in FIG. 1) to electrically connect the signal contacts 144 to the circuit board 108. In the illustrated embodiment, the contact tails 162 are compliant pins, such as eye-of-the-needle pins, that are configured to be through-hole mounted to the circuit board 108. For example, the contact tails 162 may be received in corresponding electrical vias or through-holes (not shown) defined in the circuit board 108. In another embodiment, the contact tails 162 may be solder tails configured to be surface-mounted to the circuit board 108, or the like.

The dielectric body 156 is composed of a dielectric material, such as one or more plastics. The dielectric body 156 surrounds and encases the intermediate segments 161 of the signal contacts 144 to define the signal pod 154. The dielectric body 156 holds the signal contacts 144 in fixed positions relative to each other and the dielectric body 156.

The dielectric body 156 holds the signal contacts 144 in the pair 158 apart from each other such that the signal contacts 144 do not engage one another. In an embodiment, the dielectric body 156 may be formed prior to engaging the signal contacts 144, such as via a molding process. For example, the dielectric body 156 defines two apertures 157 that extend through the dielectric body 156 between a front end 163 and a rear end 170 of the dielectric body 156. Each signal contact 144 is loaded into one of the apertures 157 during an assembly process. In an alternative embodiment, the dielectric body 156 may be formed in situ on the signal contacts 144 via overmolding. The shape of the dielectric body 156 is optionally a rectangular prism or parallelepiped, with four sides 172 extending between the front and rear ends 163, 170, but the dielectric body 156 may have other shapes in alternative embodiments. In an embodiment, the dielectric body 156 includes one or more crush ribs 174 along the sides 172. The crush ribs 174 are configured to provide an interference fit with the ground shield 146 of the corresponding contact assembly 153. In an embodiment, the dielectric body 156 includes a ledge 159 that protrudes from at least one of the sides 172. In the illustrated embodiment, the dielectric body 156 includes one ledge 159 that extends the length of the dielectric body 156 between the front end 163 and the rear end 170. The ledge 159 is located generally centrally along a width of a side 172A that is not covered by the ground shield 146. The ledge 159 may be used for aligning and retaining the contact assembly 153 relative to the base 148 of the housing 138 during assembly of the header connector 104.

When the signal pod 154 is complete (for example, assembled or formed), the mating segments 160 of the signal contacts 144 extend from the front end 163 of the dielectric body 156, the contact tails 162 extend from the rear end 170 of the dielectric body 156, and the intermediate segments 161 are disposed within the dielectric body 156. The signal contacts 144 within the dielectric body 156 are broadside-coupled in an embodiment, such that one of the broad sides 166 of one signal contact 144 faces an opposing one of the broad sides 166 of the other signal contact 144 in the pair 158. Alternatively, the signal contacts 144 may be edgeside-coupled or may have another orientation in the signal pod 154.

The ground shield 146 extends between a mating end 176 and a terminating end 178. In the illustrated embodiment, the ground shield 146 has a center wall 180 and two side walls 182 that extend from respective edges 184 of the center wall 180. The center wall 180 and the side walls 182 are generally planar. The side walls 182 may extend generally parallel to each other in a common direction from the center wall 180. Thus, the ground shield 146 has a C-shaped cross-section defined by a plane perpendicular to the center wall 180 and the two side walls 182. Optionally, the side walls 182 may be oriented at approximately right angles relative to a plane of the center wall 180. The ground shield 146 may be stamped and formed from a sheet of metal. For example, the center wall 180 may be formed integral to the side walls 182, such that the side walls 182 are bent out of plane from the center wall 180. In an alternative embodiment, the ground shield 146 may have an L-shaped cross-section defined by the center wall 180 and one side wall 182. In another alternative embodiment, the ground shield 146 may have a rectangular or box-shaped cross-section defined by two center walls 180 and the two side walls 182.

The ground shield 146 includes contact tails 186 extending from rear edges 188 of the center wall 180 and side walls 182 to the terminating end 178. The contact tails 186 in the illustrated embodiment are compliant pins configured to be through-hole mounted to the circuit board 108 (shown in FIG. 1) to provide an electrical grounding path between the ground shield 146 and the circuit board 108. Optionally, the ground shield 146 includes a tab 187 extending from each of the side walls 182 proximate to the rear edges 188. One contact tail 186 extends from each of the tabs 187. The tabs 187 may be used to match the footprint of the ground shield 146 to a designated arrangement of vias or through-holes in the circuit board 108. In an alternative embodiment, instead of compliant pins, the contact tails 186 may be solder tails configured to be surface-mounted to the circuit board 108 or another type of mounting interface. In the illustrated embodiment, the center wall 180 and the side walls 182 extend from the respective rear edges 188 to the mating end 176 of the ground shield 146. In an alternative embodiment, the ground shield 146 may include one or more projections, such as contact beams, extending from the center wall 180 and/or side walls 182 and defining the mating end 176 of the ground shield 146.

The center wall 180 and the side walls 182 of the ground shield 146 have interior sides 190 and exterior sides 192. The interior sides 190 of the walls 180, 182 define a channel 194 configured to receive a corresponding signal pod 154 therein. The exterior sides 192 face away from the channel 194. The ground shield 146 in the illustrated embodiment includes multiple protrusions 195 along the center wall 180 and the side walls 182. The protrusions 195 may be bumps, bulges, or the like that extend out from the plane of the respective walls 180, 182. Some protrusions 195 are disposed along the interior side 190 of a respective wall 180, 182, and other protrusions 195 are disposed along the exterior side 192. The protrusions 195 are located at different heights (or lengths) along the ground shield 146 between the mating and terminating ends 176, 178. In an embodiment, the protrusions 195 are clustered in a region of the ground shield 146 that is more proximate to the rear edges 188 of the walls 180, 182 than to the mating end 176.

The housing 138 is oriented in the illustrated embodiment such that the mating end 150 faces upward. The base 148 extends a length between opposite first and second ends 202, 204. The base 148 extends a width between opposite first and second edge sides 206, 208. In the illustrated embodiment, the housing 138 includes two shroud walls 140 that extend from the edge sides 206, 208. The shroud walls 140 define sides of the cavity 142. The cavity 142 is open along the first and second ends 202, 204 of the base 148. In an alternative embodiment, the housing 138 may include additional shroud walls extending along the ends 202, 204 to fully-enclose a perimeter of the cavity 142. In another alternative embodiment, the housing 138 may include only one or no shroud walls 140.

The base 148 defines chambers 210 extending through the base 148. The chambers 210 are sized and shaped to each receive a contact assembly 153 therein. Thus, the signal pod 154 and the ground shield 146 of each contact assembly 153 are commonly received in the same chamber 210. The chambers 210 are defined by chamber walls 212. The chamber walls 212 and the chambers 210 extend fully through the base 148 between the front and rear sides 112, 114.

The base 148 of the housing 138 is electrically conductive. In an embodiment, the base 148 may be composed entirely of one or more metals. For example, the base 148 may be a solid (or hollow) metal that is formed via die-casting or a different molding process. In another embodiment, the base 148 may be composed of a non-conductive core material, such as one or more plastics, that is coated in a layer of one or more metals. For example, the metal layer that coats the non-conductive core material may be applied via electro-plating, physical vapor deposition (PVD), dipping, spraying, painting, or the like. In yet another embodiment, the base 148 may be composed of an electrically lossy material that includes metal particles (for example, flakes, powder, shavings, or the like) embedded and dispersed in a non-conductive material, such as one or more plastics. The base 148 may be molded into shape using the lossy material to provide the electrical conductivity. In another embodiment, the base 148 may be composed of a conductive polymer, which is an organic polymer that conducts electricity.

The portion of the base 148 that includes chambers 210 is electrically conductive. Thus, the chamber walls 212 are electrically conductive. The entire structure of the base 148 may be electrically conductive, or alternatively one or more end portions of the base 148 are not electrically conductive. The shroud walls 140 of the housing 138 may be electrically conductive. For example, the housing 138 may have a unitary, one-piece structure that is entirely electrically conductive. Alternatively, the shroud walls 140 are not electrically conductive.

Figure 3:
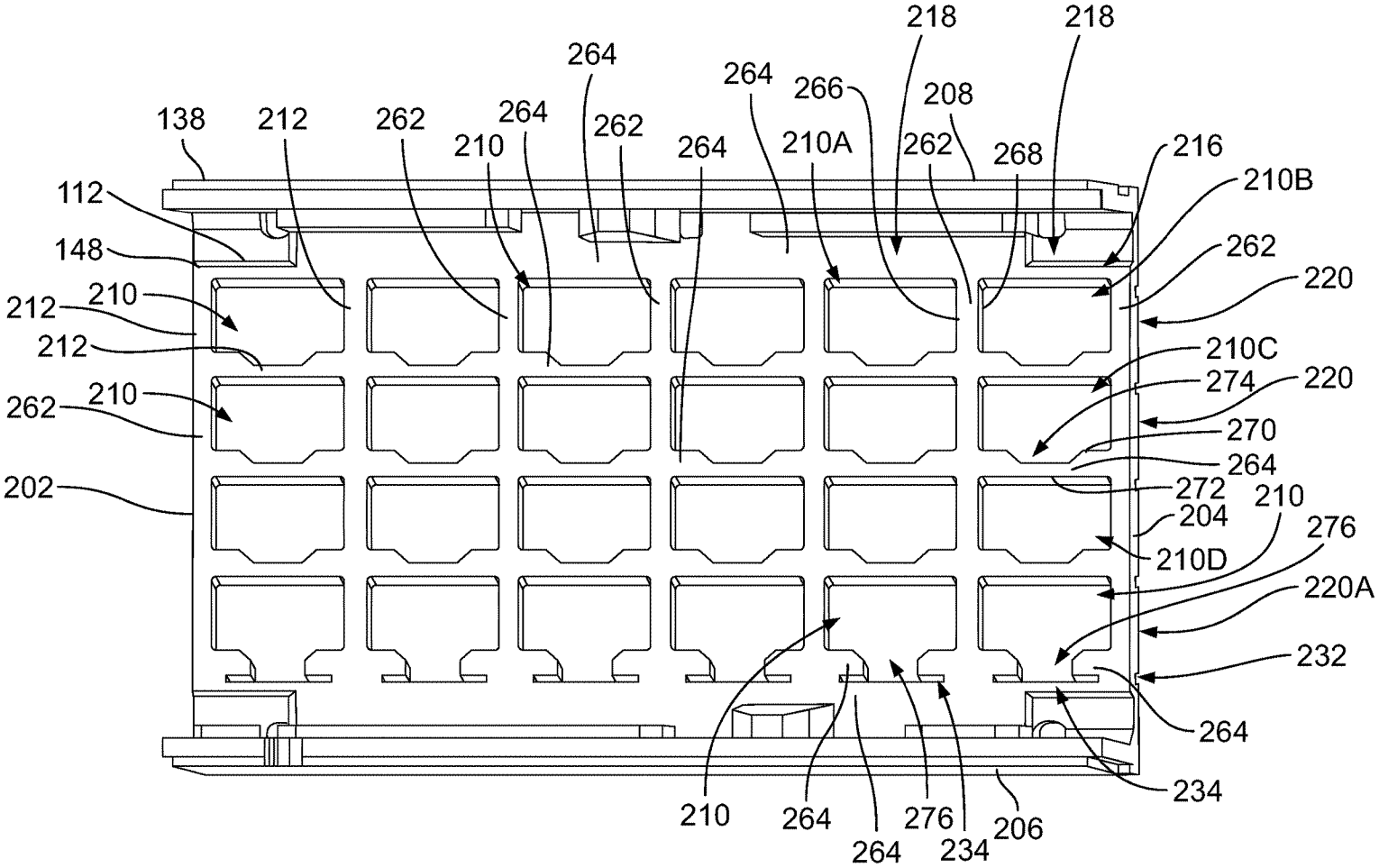
FIG. 3 shows a front side of a housing of the header connector according to an embodiment.

FIG. 3 shows the front side 112 of the base 148 of the housing 138 according to an embodiment. The chambers 210 are arranged in an array 216 of multiple columns 218 extending along the width of the base 148 between the first and second edge sides 206, 208, and multiple rows 220 extending along the length of the base 148 between the first and second ends 202, 204. The chamber walls 212 separate adjacent columns 218 and adjacent rows 220. The chambers 210 have generally rectangular shapes that are each defined by four chamber walls 212. The chamber walls 212 are arranged in a lattice-type structure. For example, the chamber walls 212 include frame walls 262 that extend parallel to one another, and cross walls 264 that extend between and connect the frame walls 262. The frame walls 262 extend parallel to the first and second ends 202, 204 of the base 148. The cross walls 264 extend parallel to the first and second edge sides 206, 208 of the base 148. Optionally, each frame wall 262 extends the width of the base 148 between the first and second edge sides 206, 208, and each cross wall 264 extends the length of the base 148 between the ends 202, 204. Each chamber 210 is defined between two adjacent frame walls 262 and between two adjacent cross walls 264.

In an embodiment, some of the chamber walls 212 are divider walls or septums that define portions of multiple chambers 210. For example, at least some of the frame walls 262 extend between and define portions of two adjacent chambers 210 in one row 220. Thus, a left surface 266 of one of the frame walls 262 defines a right side of a left chamber 210A, and a right surface 268 of the same frame wall 262 defines a left side of a right chamber 210B. The frame walls 262 that define the first and second ends 202, 204 of the base 148 do not extend between and define portions of multiple chambers 210 in the same row 220. Furthermore, at least some of the cross walls 264 extend between and define portions of two adjacent chambers 210 in one column 218. Thus, a top surface 270 of one of the cross walls 264 defines a bottom side of a top chamber 210C, and a bottom surface 272 of the same cross wall 264 defines a top side of a bottom chamber 210D. The cross walls 264 that define the first and second edge sides 206, 208 of the base 148 do not extend between and define portions of multiple chambers 210 in the same column 218. As used herein, relative or spatial terms such as "front," "rear," "top," "bottom," "first," "second," "left," and "right" are only used to distinguish the referenced elements and do not necessarily require particular positions or orientations relative to the surrounding environment of the header connector 104 (shown in FIG. 1) or the connector assembly 100 (FIG. 1).

In an embodiment, at least one of the chamber walls 212 defining each of the chambers 210 includes a groove-shaped recess 274 that is open to the chamber 210. In the illustrated embodiment, the recesses 274 are defined along the top surfaces 270 of the cross walls 264 that extend between two chambers 210 in the same column 218. The recesses 274 are configured to receive the ledges 159 (shown in FIG. 2) of the dielectric bodies 156 (FIG. 2) therein when the contact assemblies 153 (FIG. 2) are loaded into the chambers 210. The chambers 210 are sized and shaped such that a contact assembly 153 can only be received in a corresponding chamber 210 in the orientation in which the ledge 159 aligns with the recess 274, in order to properly orient the contact assemblies 153 in the base 148.

The base 148 further defines a row 232 of orphan slots 234 between the first edge side 206 of the base 148 and a first row 220A of chambers 210 that is most proximate to the first edge side 206. The orphan slots 234 are aligned with the columns 218 of chambers 210. Each of the orphan slots 234 is generally linear and oriented parallel to the first edge side 206. The orphan slots 234 are configured to receive orphan shields 240 (shown in FIGS. 4 and 7) therein. The orphan shields 240 may resemble the center walls 180 (shown in FIG. 2) of the ground shields 146 (FIG. 2). The orphan shields 240 in the orphan slots 234 provide shielding for the signal contacts 144 (FIG. 2) disposed in the chambers 210 of the row 220A. In an embodiment, the cross walls 264 located between the orphan row 232 and the first row 220A of chambers 210 are fragmented and define channels 276 between the chambers 210 in the first row 220A and the orphan slots 234. Thus, the chambers 210 in the first row 220A are each open to one of the orphan slots 234 via the channel 276 extending through the cross wall 264. Fragmenting the cross walls 264 between the chambers 210 in the first row 220A and the orphan slots 234 may be useful for reducing the cost and complexity of manufacturing the electrically conductive base 148 of the housing 138. For example, electro-plating a non-conductive core material of the base 148 or molding a conductive polymer may be more efficient and/or reliable with the fragmented cross walls 264 relative to un-fragmented cross walls 264 between the chambers 210 and the orphan slots 234. In an alternative embodiment, the cross walls 264 between adjacent rows 220 of chambers 210 may also be fragmented. In another alternative embodiment, none of the cross walls 264 is fragmented to define a channel.

Figure 4:
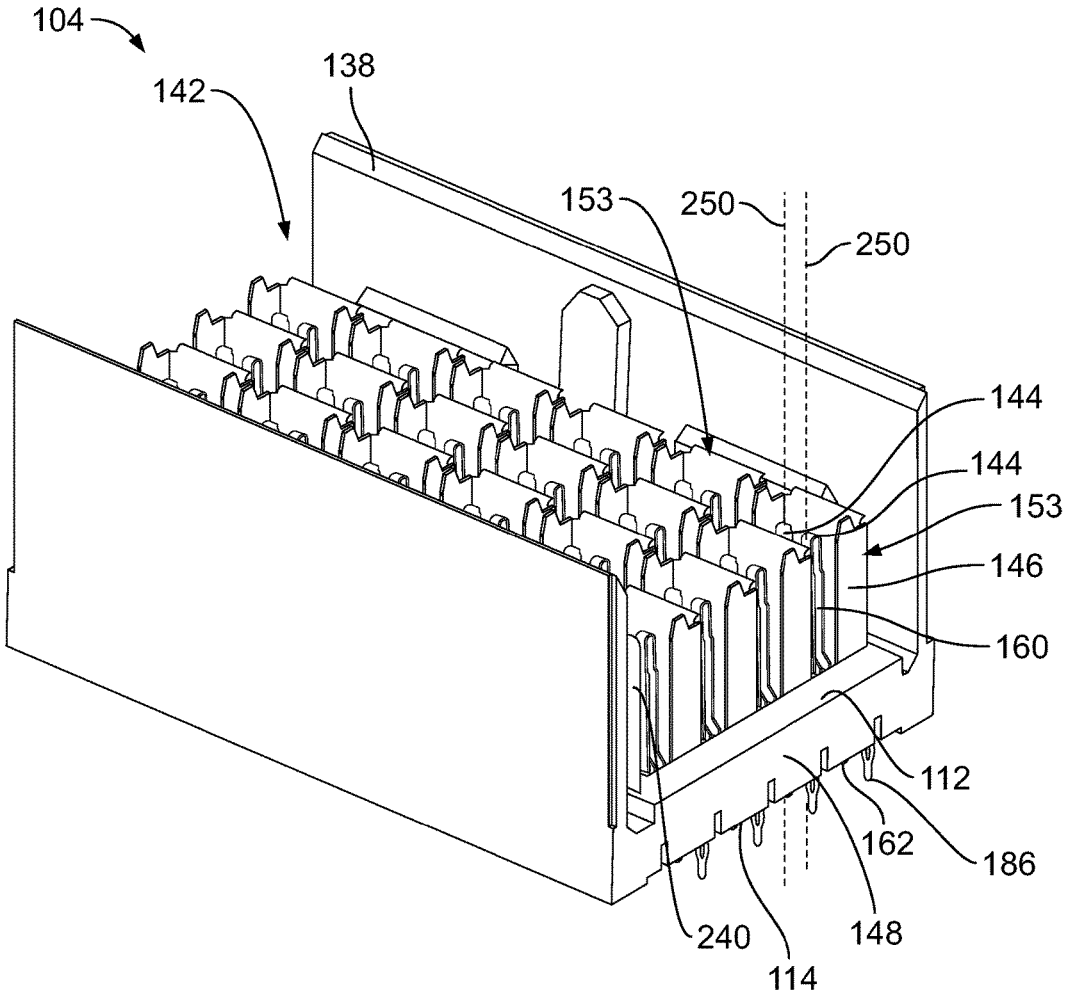
FIG. 4 is a perspective view of the header connector according to an embodiment.

FIG. 4 is a perspective view of the header connector 104 according to an embodiment. In FIG. 4, the contact assemblies 153 are loaded in the chambers 210 (shown in FIG. 3) of the base 148 of the housing 138. FIG. 4 also shows a portion of one orphan shield 240 held in an orphan slot 234 (FIG. 3). The mating segments 160 of the signal contacts 144 extend from the front side 112 of the base 148 into the cavity 142 to mate with signal contacts of the receptacle connector 102 (shown in FIG. 1). The contact tails 162 of the signal contacts 144 extend from the rear side 114 of the base for terminating to the circuit board 108 (shown in FIG. 1). The signal contacts 144 may extend along contact axes 250 through the base 148. In an embodiment, the front side 112 of the base 148 is parallel to the rear side 114, and the contact axes 250 are perpendicular to the planes defined by the front and rear sides 112, 114. The ground shields 146 also extend from the front side 112 of the base 148 into the cavity 142 to surround and electrically shield the mating segments 160 of the signal contacts 144. The portions of the ground shields 146 in the cavity 142 are configured to mate with ground contacts of the receptacle connector 102. The contact tails 186 of the ground shields 146 extend from the rear side 114 of the base 148 for terminating to the circuit board 108.

Figure 5:
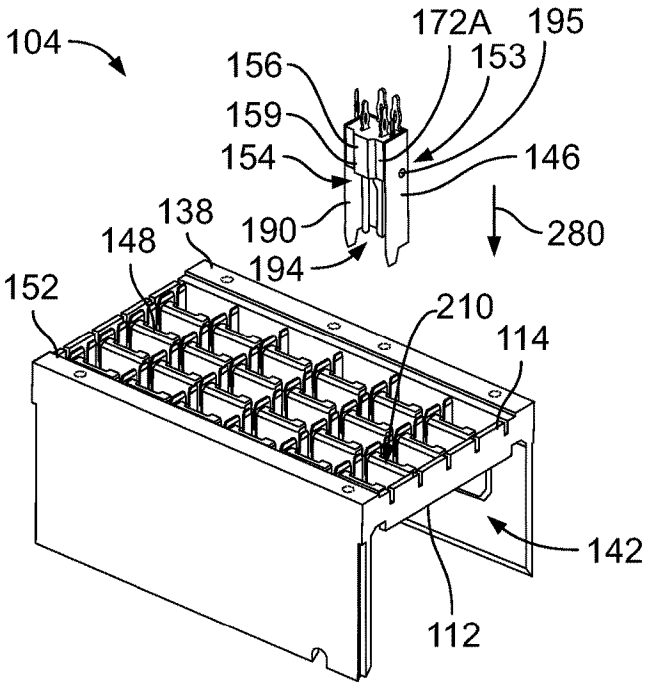
FIG. 5 is an exploded perspective view of the header connector showing one contact assembly poised for loading into the housing of the header connector according to an embodiment.

FIG. 5 is an exploded perspective view of the header connector 104 showing one of the contact assemblies 153 poised for loading into the housing 138 according to an embodiment. The housing 138 is oriented in the illustrated embodiment such that the mounting end 152 faces upward. The rear end 114 of the base 148 defines the mounting end 152. Prior to loading into the housing 138, the contact assembly 153 is assembled such that the signal pod 154 is received and held in the channel 194 of the ground shield 146. The ground shield 146 surrounds the signal pod 154 on three sides. In an alternative embodiment, the ground shield 146 may surround the signal pod 154 on two sides or may surround the signal pod 154 on all four sides. In the illustrated embodiment, the dielectric body 156 engages the interior sides 190 of the ground shield 146. The signal pod 154 may be held in the channel 194 of the ground shield 146 via an interference fit between the dielectric body 156 and the ground shield 146. For example, the dielectric body 156 may engage the protrusions 195 (shown in FIG. 2) that are located along the interior sides 190 of the ground shield 146 to secure the signal pod 154 in the ground shield 146. As shown in FIG. 5, the ledge 159 of the dielectric body 156 does not engage the ground shield 146. The ledge 159 is located along the side 172A of the dielectric body 156 that is not surrounded by the ground shield 146.

The contact assembly 153 is inserted into a corresponding chamber 210 by moving the contact assembly 153 relative to the housing 138 in a loading direction 280. The signal pod 154 and the ground shield 146 of each contact assembly 153 are inserted as a single package into a same chamber 210. In the illustrated embodiment, the contact assembly 153 is loaded into the base 148 from the rear side 114 towards the front side 112, but the contact assemblies 153 may be configured to be loaded in the reverse direction in other embodiments.

Figure 6:
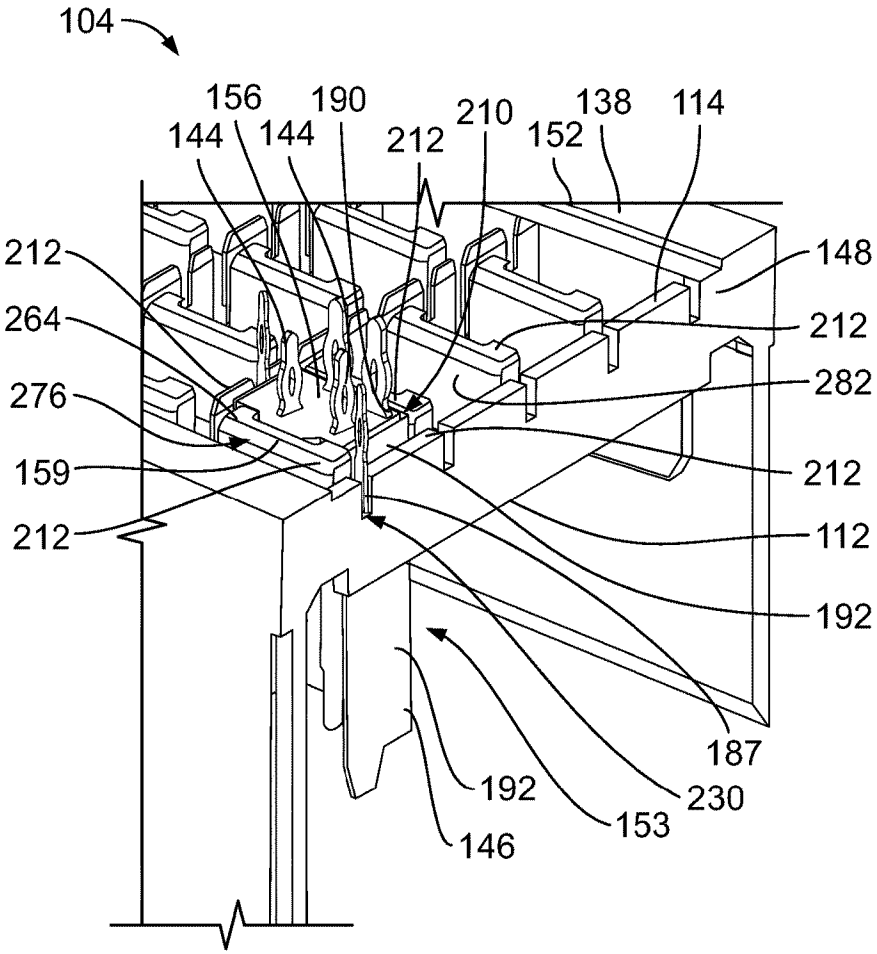
FIG. 6 is a close-up perspective view of a portion of the header connector showing one contact assembly loaded in the housing according to an embodiment.

FIG. 6 is a close-up perspective view of a portion of the header connector 104 showing one of the contact assemblies 153 disposed in the housing 138 according to an embodiment. The mounting end 152 of the housing 138, defined by the rear side 114 of the base 148, faces upward in the illustrated embodiment. The contact assembly 153 is received in one of the chambers 210. The exterior sides 192 of the ground shield 146 of the contact assembly 153 engage the chamber walls 212 that define the chamber 210 to electrically connect the ground shield 146 to the electrically conductive base 148. Although only one contact assembly 153 is shown in FIG. 6, the chamber walls 212 of the base 148 may be used to indirectly electrically connect the ground shields 146 of multiple contact assemblies 153 together to electrically common the ground shields 146. In the illustrated embodiment, the ground shield 146 engages three of the four chamber walls 212 that define the chamber 210 in which the contact assembly 153 is disposed. The dielectric body 156 of the contact assembly 153 engages the fourth chamber wall 212 that is not engaged by the ground shield 146. The fourth chamber wall 212 in the illustrated embodiment is a fragmented cross wall 264. The ledge 159 of the dielectric body 156 extends into the channel 276 defined through the cross wall 264. The signal contacts 144 of the contact assembly 153 are spaced apart from each other, from the ground shield 146 of the contact assembly 153, and from the chamber walls 212 of the base 148 via the dielectric body 156.

In an embodiment, the ground shield 146 of the contact assembly 153 may engage the chamber walls 212 at multiple contact locations along a height of the base 148 between the front side 112 and the rear side 114 to electrically connect the ground shield 146 to the base 148 at the multiple contact locations. The exterior sides 192 of the ground shield 146 and/or the protrusions 195 (shown in FIGS. 2 and 5) along the exterior sides 192 may engage inner surfaces 282 of the chamber walls 212 (for example, the surfaces 266, 268 of the frame walls 262 and/or the surfaces 270, 272 of the cross walls 264 shown in FIG. 3) at multiple different locations along the height of the base 148. For example, one protrusion 195 on the ground shield 146 may engage an inner surface 282 of one chamber wall 212 at a first contact location that is proximate to the rear side 114, and another protrusion 195 on the same ground shield 146 may engage the inner surface 282 of the same or a different one of the chamber walls 212 at a different, second contact location that is more proximate to the front side 112 (relative to the proximity of the first contact location to the front side 112).

The contact assembly 153 may be secured in the chamber 210 to fix the position of the contact assembly 153 relative to the housing 138. The contact assembly 153 may be held in the chamber 210 via an interference fit. For example, the dielectric body 156 may engage the interior sides 190 of the ground shield 146 and force the ground shield 146 outward against the chamber walls 212 to increase the friction between the ground shield 146 and the chamber walls 212, as well as retain a conductive electrical connection between the ground shield 146 and the chamber walls 212. The dielectric body 156 may be at least partially compressed within the chamber 210. The crush ribs 174 (shown in FIG. 2) of the dielectric body 156 may be used to force the ground shield 146 outward. In other embodiments, the dielectric body 156 and/or the chamber walls 212 may include stop features or other projections that secure the dielectric body 156 within the chamber 210 to fix the contact assembly 153 relative to the base 148.

In an embodiment, the base 148 further includes grooves 230 defined in the chamber walls 212 along the rear side 114 of the base 148. The grooves 230 are open to the chambers 210 and extend laterally therefrom into or through the chamber walls 212. The grooves 230 receive the tabs 187 of the ground shields 146 therein. The engagement between the tabs 187 and the grooves 230 may also provide a hard stop interface as the contact assembly 153 is being loaded into the chamber 210 that prevents the contact assembly 153 from being loaded beyond a desired loaded position.

Figure 7:
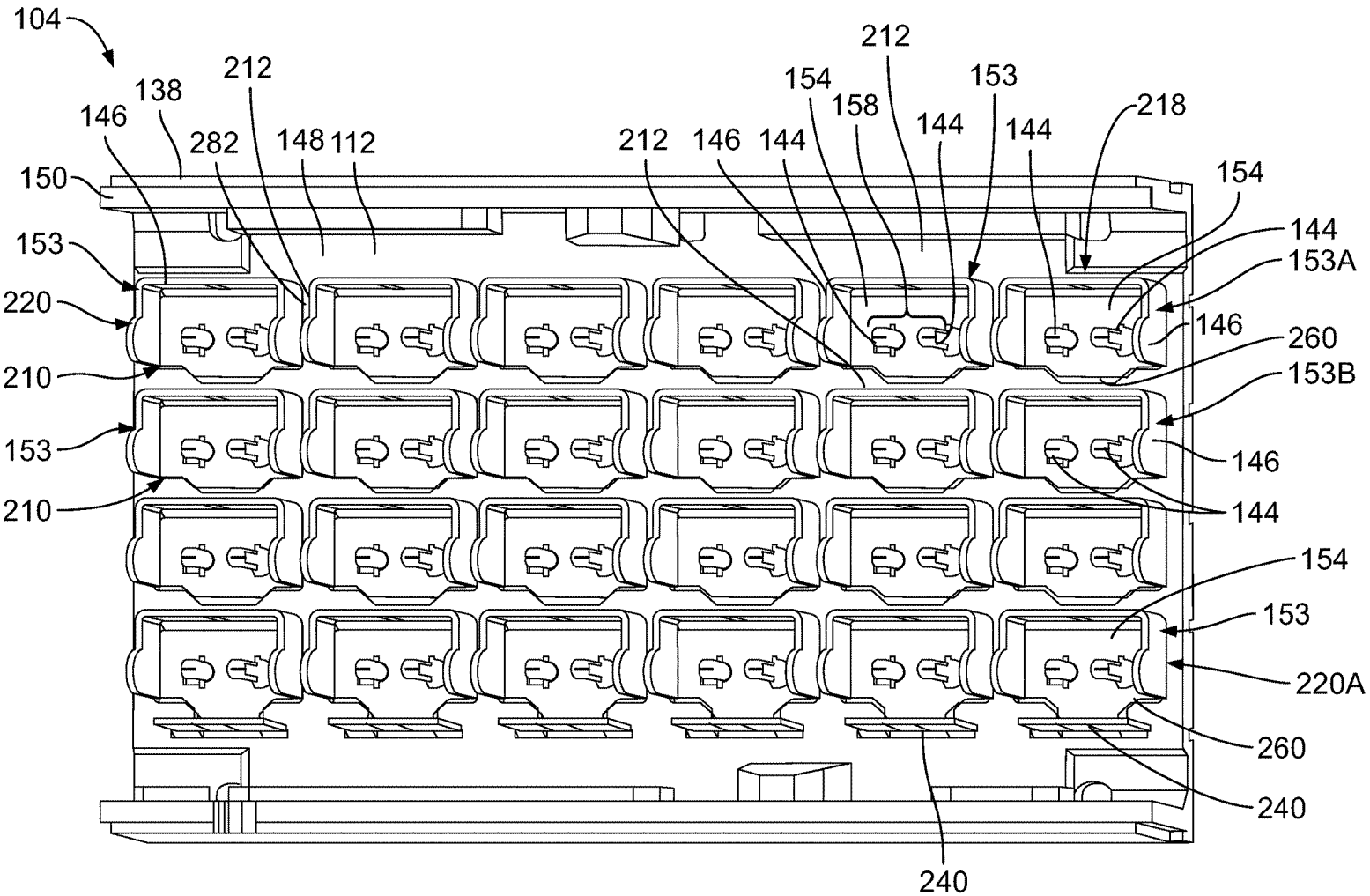
FIG. 7 shows the header connector along a mating end of the housing according to an embodiment.

FIG. 7 shows the header connector 104 along the mating end 150 of the housing 138 according to an embodiment. The contact assemblies 153 are disposed in the chambers 210. The ground shields 146 of the different contact assemblies 153 engage the electrically conductive chamber walls 212 of the base 148, and are electrically commoned to one another indirectly via the chamber walls 212. For example, electrical current is allowed to flow along the chamber walls 212 between the front side 112 and the rear side 114 (shown in FIG. 6) of the base 148. In an embodiment, the ground shields 146 engage the inner surfaces 282 of the chamber walls 212 at different contact locations along the height of the base 148 and are electrically commoned along the height of the base 148, not merely at a single grounding plane. Electrically commoning the ground shields 146 of the contact assemblies 153 at multiple locations along the height of the base 148 may improve the electrical performance of the header connector 104 by reducing interference and resonance.

The ground shields 146 are positioned between the signal pods 154 of adjacent contact assemblies 153 to provide electrical shielding between adjacent pairs 158 of signal contacts 144. In the illustrated embodiment, the ground shield 146 of each contact assembly 153 has a C-shaped cross-section and surrounds the associated signal pod 154 on three sides thereof. The ground shield 146 of an adjacent contact assembly 153 provides shielding along the open, fourth side of the signal pod 154. Therefore, the pairs 158 of signal contacts 144 are shielded from adjacent pairs 158 in the same column 218 and adjacent pairs 158 in the same row 220. For example, the ground shield 146 of a first contact assembly 153A provides shielding for the signal contacts 144 of the first contact assembly 153A on three sides of the signal pod 154 of the first contact assembly 153A. The ground shield 146 of a second contact assembly 153B adjacent to the first contact assembly 153A in the same column 218 provides shielding for the signal contacts 144 of the first contact assembly 153A along an open, fourth side 260 of the signal pod 154 of the first contact assembly 153A. The ground shield 146 of the second contact assembly 153B provides shielding for the signal contacts 144 of the second contact assembly 153B on three sides thereof. As shown in FIG. 7, the orphan shields 240 provide shielding for the contact assembles 153 in the first row 220A along the open, fourth sides 260 of the signal pods 154. Although not shown, the shape and/or size of the ground shields 146 may change along different portions thereof for impedance control or control of other electrical characteristics.

Figure 8:
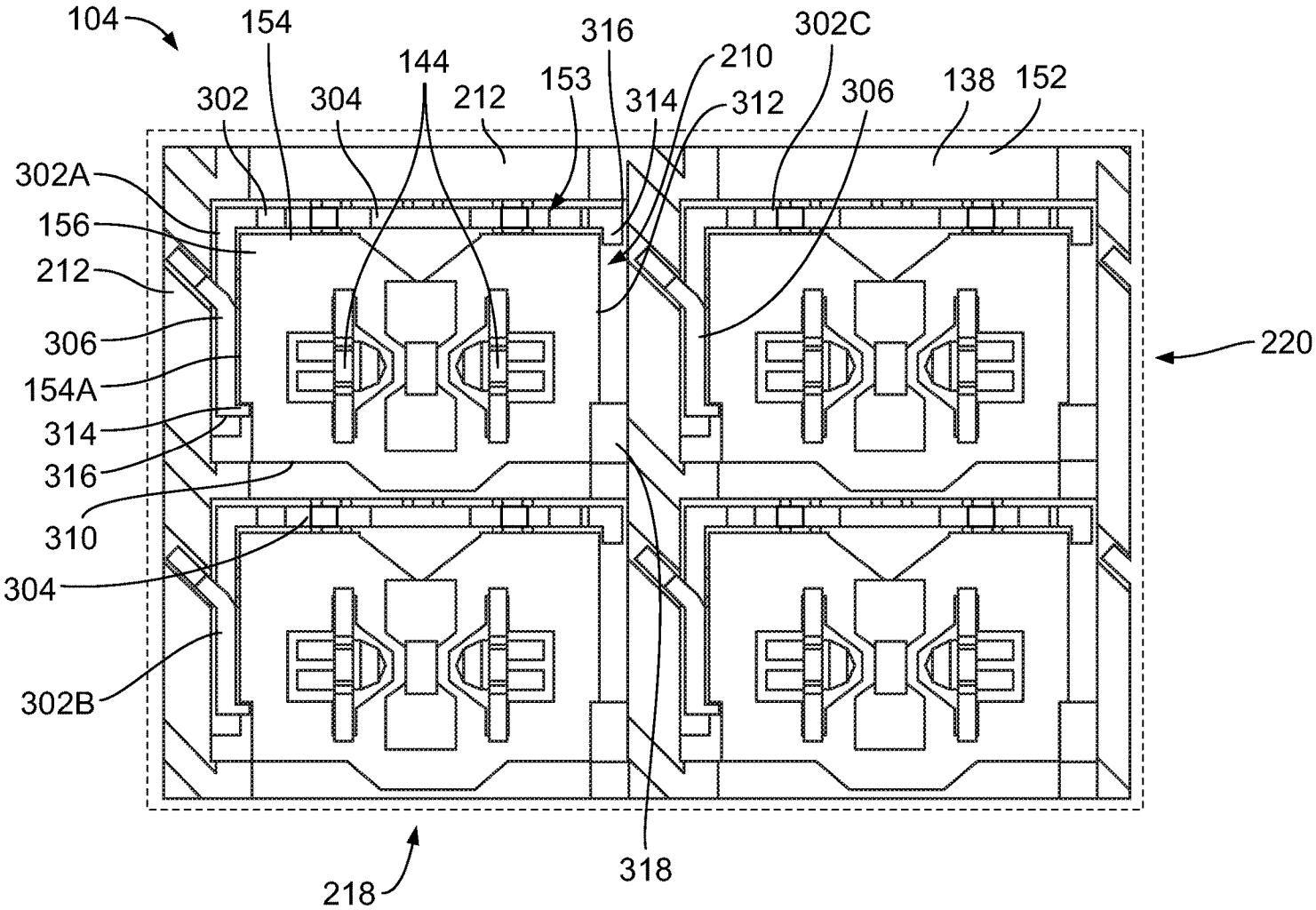
FIG. 8 shows a portion of the header connector along a mounting end of the housing according to an alternative embodiment.

FIG. 8 shows a portion of the header connector 104 along the mounting end 152 of the housing 138 according to an alternative embodiment. In the illustrated embodiment, the contact assemblies 153 include ground shields 302 that are L-shaped instead of C-shaped, having a center wall 304 and one side wall 306 extending from an edge of the center wall 304. The walls 304, 306 of the ground shield 302 engage the dielectric body 156 of the corresponding signal pod 154 of the contact assembly 153. The ground shield 302 surrounds the corresponding signal pod 154 of the contact assembly 153 on two sides thereof to provide electrical shielding for the signal contacts 144 in the signal pod 154 from other signal contacts 144. For example, a first ground shield 302A surrounds a first signal pod 154A on two sides. The center wall 304 of a second ground shield 302B adjacent to the first ground shield 302A in the same column 218 provides shielding for the first signal pod 154A along an open, third side 310 of the first signal pod 154A. The side wall 306 of a third ground shield 302C adjacent to the first ground shield 302A in the same row 220 provides shielding for the first signal pod 154A along an open, fourth side 312 of the first signal pod 154A such that the first signal pod 154A is shielded on all four sides.

The ground shields 302 may be mechanically secured and/or chemically bonded to the corresponding dielectric bodies 156 of the contact assemblies 153 to retain each ground shield 302 in a fixed position relative to the corresponding dielectric body 156. For example, as shown in FIG. 8, the center wall 304 and the side wall 306 of each ground shield 302 may include a hook 314 (e.g., a hook-like protrusion) extending from a free end 316 of the respective wall 304, 306. The two hooks 314 are configured to latch onto the dielectric body 156, mechanically coupling the ground shield 302 to the dielectric body 156. Alternatively, the ground shield 302 may include at least one protrusion more proximate to the intersection between the center wall 304 and the side wall 306 that is configured to pierce the dielectric body 156 to anchor the ground shield 302 relative to the dielectric body 156. In other alternative embodiments, the ground shield 302 may be chemically bonded to the dielectric body 156 via one or more adhesives between the ground shield 302 and the dielectric body 156.

In the illustrated embodiment, the housing 138 includes positioning tabs 318 extending into each chamber 210 and engaging the dielectric body 156 of the contact assembly 153 therein. The positioning tabs 318 in the chambers 210 bias the contact assemblies 153 into engagement with the electrically conductive chamber walls 212 of the housing 138 to electrically common the ground shields 302 of the contact assemblies 153.

Although not shown in the portion of the connector 104 illustrated in FIG. 8, the connector 104 may further include orphan shields arranged in an orphan row that provides shielding along the open, third sides 310 of the signal pods 154 of the contact assemblies 153 in the row 220 most proximate to the first edge side 206 (shown in FIG. 2) of the housing 138. Additional orphan shields may be arranged in an orphan column that provides shielding along the open, fourth sides 312 of the signal pods 154 of the contact assemblies 153 in the column 218 most proximate to the second end 204 (FIG. 2) of the housing 138. Therefore, the signal pods 154 of every contact assembly 153 may be shielded on all four sides. More or less shield walls may be provided in alternative embodiments. The walls may be bent or angled rather than being planar.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing extending between a mating end and a mounting end, the housing including shroud walls and a base having a front side and a rear side, the rear side of the base defining the mounting end, the shroud walls extending from the base to the mating end, the front side of the base and the shroud walls defining a cavity configured to receive a mating connector therein, the base being electrically conductive, the base having chambers extending therethrough, the chambers defined by chamber walls that extend from the front side to the rear side of the base; and contact assemblies disposed in the chambers of the base, each contact assembly having a signal pod surrounded on at least two sides by a ground shield having interior sides and exterior sides, the signal pod including a dielectric body holding a pair of signal contacts, the dielectric body engaging the interior sides of the ground shield to electrically insulate the signal contacts from the ground shield, the exterior sides of the ground shield engaging the chamber walls of the base to electrically connect the ground shield to the base, wherein the dielectric bodies of the contact assemblies include crush ribs protruding from sides of the dielectric bodies, the crush ribs of the dielectric body of the contact assembly in a corresponding chamber engaging the interior sides of the ground shield of the contact assembly and forcing the ground shield outward against the chamber walls of the chamber to secure the contact assembly in the chamber via an interference fit.

2. The electrical connector of claim 1, wherein the signal contacts of the contact assemblies have mating segments protruding from the dielectric body and extending from the front side of the base into the cavity to mate with signal contacts of the mating connector, the ground shields extending into the cavity to shield the mating segments of the signal contacts and mate with ground contacts of the mating connector.

3. The electrical connector of claim 1, wherein the mounting end of the housing is configured to be mounted to a circuit board, the signal contacts of the contact assemblies having contact tails protruding from the dielectric body and extending from the rear side of the base for terminating to the circuit board, the ground shields having contact tails extending from the rear side of the base for terminating to the circuit board.

4. The electrical connector of claim 1, wherein the chambers are arranged in an array of rows and columns, the chamber walls including frame walls that are parallel to one another and cross walls that extend between and connect the frame walls, at least some of the frame walls extending between and defining portions of two adjacent chambers in one row, at least some of the cross walls extending between and defining portions of two adjacent chambers in one column.

5. The electrical connector of claim 4, wherein the base defines a row of orphan slots disposed between an edge side of the base and a first row of chambers that is most proximate to the edge side, the orphan slots aligning with the columns of chambers, the cross walls located between the orphan row and the first row of chambers being fragmented to define channels between the chambers in the first row and the orphan slots.

6. The electrical connector of claim 1, wherein the ground shields have C-shaped cross-sections and include a center wall and two side walls extending from opposite edges of the center wall.

7. The electrical connector of claim 1, wherein each chamber is defined by four chamber walls, the ground shield of the contact assembly in a corresponding chamber engaging three of the four chamber walls, the dielectric body of the contact assembly engaging a fourth of the four chamber walls that is not engaged by the ground shield.

8. The electrical connector of claim 1, wherein the ground shield of the contact assembly in a corresponding chamber engages the chamber walls that define the chamber at multiple contact locations along a height of the base between the front side and the rear side to electrically connect the ground shield to the base at the multiple contact locations.

9. The electrical connector of claim 1, wherein the base of the housing is at least one of composed entirely of one or more metals, composed of a non-conductive core material coated in a layer of one or more metals, composed of a lossy material having metal particles embedded in a non-conductive material, composed of a conductive polymer, or composed of a carbon-filled polymer.

10. The electrical connector of claim 1, wherein the chambers are arranged in an array of columns and rows, the ground shields of the contact assemblies in the chambers being spaced apart from one another, the ground shields of different contact assemblies being electrically connected to one another via the electrically conductive base.

11. The electrical connector of claim 1, wherein the ground shield of a first contact assembly provides shielding for the signal contacts of the first contact assembly on three sides of the signal pod of the first contact assembly and the ground shield of a second contact assembly adjacent to the first contact assembly provides shielding for the signal contacts of the first contact assembly along an open, fourth side of the signal pod of the first contact assembly.

12. The electrical connector of claim 1, wherein the front side of the base is parallel to the rear side, the signal contacts of the contact assemblies extending along contact axes through the dielectric bodies, the contact axes being perpendicular to the front and rear sides of the base.

13. An electrical connector comprising:

a housing having a base extending between a front side and a rear side, the base being electrically conductive, the base having chambers extending therethrough, the chambers defined by chamber walls that extend from the front side to the rear side of the base, wherein the chambers are arranged in columns and rows and the chamber walls extend between and fully separate each chamber from the other chambers, the chamber walls including frame walls that separate the chambers disposed in adjacent columns and cross walls that separate the chambers disposed in adjacent rows; and contact assemblies disposed in the chambers of the base, each contact assembly having a signal pod surrounded on at least two sides by a ground shield, the signal pod including a dielectric body holding a pair of signal contacts along respective intermediate segments thereof, the dielectric body having a front end and a rear end that is opposite the front end, the signal contacts including mating segments that protrude beyond the front end of the dielectric body and the front side of the base, wherein the mating segment of each of the signal contacts protrudes from the front end of the dielectric body a length that is greater than a height of the dielectric body from the rear end to the front end, wherein the ground shield of each contact assembly has a center wall and a side wall, the dielectric body engaging interior sides of the center wall and the side wall to electrically insulate the signal contacts from the ground shield, wherein an exterior side of the center wall engages a corresponding one of the cross walls of the chamber walls of the base and an exterior side of the side wall engages a corresponding one of the frame walls of the chamber walls to electrically connect the ground shield to the base, the ground shield engaging the chamber walls at multiple contact locations along a height of the base between the front side and the rear side.

14. The electrical connector of claim 13, wherein the ground shields of the contact assemblies extend lengths between respective mating ends and terminating ends, at least some of the ground shields including protrusions along one or more of the center wall or the side wall that engage the chamber walls of the base, at least some of the protrusions of a corresponding ground shield disposed at different locations along the length of the ground shield.

15. The electrical connector of claim 13, wherein the housing extends between a mating end and a mounting end that is defined by the rear side of the base, the housing including shroud walls extending from the base to the mating end, the base and the shroud walls defining a cavity configured to receive the mating connector therein, the signal contacts having mating segments protruding from the dielectric body and extending from the front side of the base into the cavity to mate with signal contacts of the mating connector, the ground shields extending into the cavity to shield the mating segments of the signal contacts and mate with ground contacts of the mating connector.

16. The electrical connector of claim 15, wherein the shroud walls of the housing are not electrically conductive.

17. The electrical connector of claim 15, wherein the base of the housing is composed of a non-conductive core material coated in a layer of one or more metals and the shroud walls are composed of the non-conductive core material and lack the layer of the one or more metals such that the shroud walls are not electrically conductive.

18. The electrical connector of claim 13, wherein the dielectric bodies of the contact assemblies include crush ribs protruding from sides of the dielectric bodies, wherein the crush ribs of the dielectric body of the contact assembly in a corresponding chamber engage the interior sides of the center wall and the side wall of the ground shield and force the ground shield outward against the chamber walls of the base.

19. An electrical connector comprising:

a housing having a base extending between a front side and a rear side, the base being electrically conductive, the base having chambers extending therethrough, the chambers defined by chamber walls that extend from the front side to the rear side of the base; and contact assemblies disposed in the chambers of the base, each contact assembly having a signal pod surrounded on at least two sides by a ground shield having interior sides and exterior sides, the signal pod including a dielectric body holding a pair of signal contacts, the dielectric body being overmolded around the pair of signal contacts along respective intermediate segments of the signal contacts, the dielectric body engaging the interior sides of the ground shield to electrically insulate the signal contacts from the ground shield, the exterior sides of the ground shield engaging the chamber walls of the base to electrically connect the ground shield to the base, the exterior sides of the ground shield engaging the chamber walls at multiple contact locations along a height of the base between the front side and the rear side to electrically connect the ground shield to the base at the multiple contact locations, wherein the dielectric bodies of the contact assemblies include crush ribs protruding from sides of the dielectric bodies, the crush ribs of the dielectric body of the contact assembly in a corresponding chamber engaging the interior sides of the ground shield of the contact assembly and forcing the ground shield outward against the chamber walls of the chamber to secure the contact assembly in the chamber via an interference fit.

* * * * *